US005364263A

United States Patent [19]

Doo-Seok

[11] Patent Number: 5,364,263

[45] Date of Patent: Nov. 15, 1994

[54] GAS LIGHTER EQUIPPED WITH DISPOSABLE RAZOR

[76] Inventor: Kee Doo-Seok, 402 ho, 4 Floor, Duckchang Building 24-1, Suha-dong Chung-ku, Seoul, Rep. of Korea

[21] Appl. No.: 132,361

[22] Filed: Oct. 6, 1993

[51] Int. Cl.[5] ..... B26B 19/00

[52] U.S. Cl. ..... 431/253; 30/34.05

[58] Field of Search ..... 431/253; 30/34.05

[56] References Cited

U.S. PATENT DOCUMENTS 2,828,855 4/1958 Mosch ..... 431/253

4,542,828 9/1985 Gotto ..... 30/34.05

4,897,033 1/1990 Yang ..... 431/253

*Primary Examiner*—Carroll B. Dority

*Attorney, Agent, or Firm*—Arnold, White & Durkee

[57] ABSTRACT

A gas lighter (10) equipped with a disposable razor, wherein a part of the gas lighter's body is so shaped as to be suitable to fix a removable housing (28) which on one hand contains a disposable razor blade assembly (17) therein in ordinary times and on the other hand is used as a handle of the razor during shaving. The gas lighter equipped according to the present invention provides increased the convenience and portability of the razor to the user since it can be kept and contained inside the housing (23) whose shape is coincidental with the recess (5) of the gas lighter.

5 Claims, 3 Drawing Sheets

GAS LIGHTER EQUIPPED WITH DISPOSABLE RAZOR

BACKGROUND OF THE INVENTION

This application claims priority from Korean Utility Model Application No. 12127/1992, which was filed on Oct. 6, 1992.

This invention relates to a gas lighter equipped with a disposable razor, and, in particular, to a type of gas lighter, the body part of which has an L-shaped recess to which a removable housing is fixed which housing contains a disposable razor blade assembly therein and is also so shaped as to be used as a handle of the razor during shaving.

In general, coventional disposable razors may be divided into two types; one type is that composed of two separated elements, that is, a handle which is not discarded but used continuously and a disposable razor blade assembly which can be inter changeably fitted to the head of the handle, the other being the type where the handle and the razor blade assembly are so formed in a single body that the handle and the razor blade assembly are to be discarded at the same time after use.

The separated type is suitable for home use and has economical merits in that the handle, which is comparatively more expensive than the razor blade assembly, may be saved for continued use by replacing only the used disposable razor blade assembly with a new one after its use. However, in consideration that a disposable separated razor of this type must usually be carried in a certain package or case, it is somewhat inconvenient, unhandy or bulky to carry around on one's person if one wants to conveniently provide oneself with the razor at most times in one's jacket, shirt or trousers pocket.

On the contrary, the single body type is so formed whereby its handle is made of comparatively less expensive material than that of the separated type so that it may be said to be more advantageous economically than the separated type when it is used for the purpose of one time only use.

However, the single body type has some disavantages in that the handle and the razor blade assembly must be discarded simultaneously after use, therefore, even though the manufacturing cost of this type razor is less expensive than that of the separated type razor, it is resource consumptive and is still inconvenient, unhandy or bulky to carry around on one's person at most times in one's jacket, shirt or trousers pocket and is unfavorable in view of environmental protection.

SUMMARY OF THE INVENTION

The present invention is intended to provide a gas lighter equipped with a disposable razor blade assembly, wherein a part of the gas lighter's body is so shaped as to be suitable to fix a removable housing which contains a disposable razor blade assembly therein and which housing is used as a handle of the razor in shaving wherein one need not buy the comparatively more expensive handle and one can increase the portability of the razor at most times since the razor blade assembly can be contained inside the housing whose shape is coincidental with the recess of the gas lighter.

DETAILED DESCRIPTION OF THE INVENTION

Figure 1:
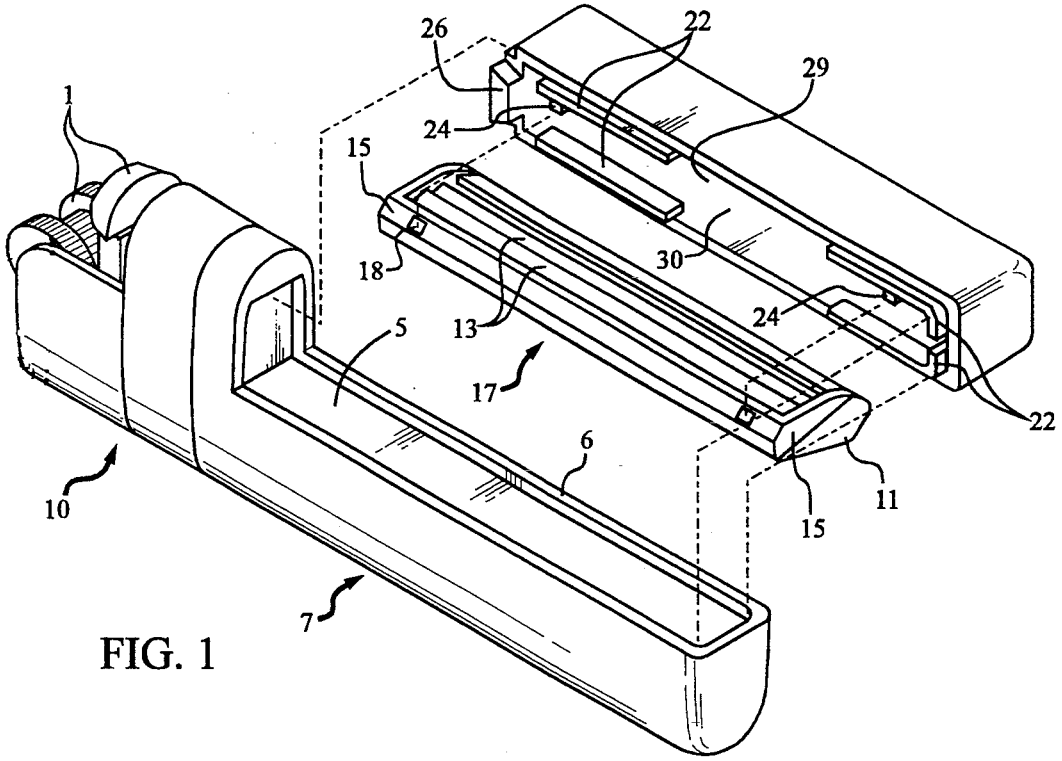
FIG. 1 is a exploded perspective view of the gas lighter equipped with the disposable razor blade assembly according to the present invention.

As shown in FIG. 1, the gas lighter equipped with a disposable razor assembly according to the present invention is characterised in that said gas lighter comprises:

(a) a gas lighter body (10) comprising an elongated casing (7) having a longitudinal axis, an outer surface having an L-shaped recess (5) formed along with said longitudinal axis and a conventional igniting means (1) at one end of said elongated casing; and (b) a housing (28) which has a longitudinal hollow space (29) to keep a conventional disposable razor blade assembly (17) therein, a longitudinal opening (30) through which the disposable razor blade assembly (17) can be inserted and removed, a connecting means (26) so formed on the upper end of the brim of said longitudinal opening (30) that said connecting means enables the housing to be connected with easily or removed from the back side of the razor blade assembly (17) by virtue of such connecting means' T-shape, and whereby said housing (28) can be used as a handle of the razor during shaving, and a fixing means (22) so formed on the brim of longitudinal direction as to fix or easily remove said housing (28) with said longitudinal recess (5) of the lighter.

The gas lighter equipped with the disposable razor according to the present invention can further comprise a conventional disposable razor blade, the razor blade assembly of which is kept contained in said space of the housing at most times but is taken out and assembled to form a T-shape be attachment to the housing handle and used as a razor in shaving.

Figure 2:
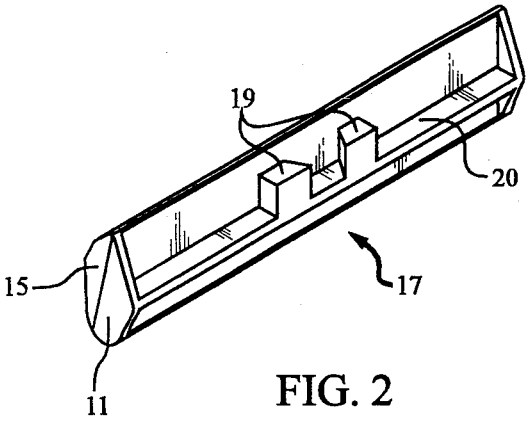
FIG. 2 is a back view of the disposable razor blade.
Figure 3:
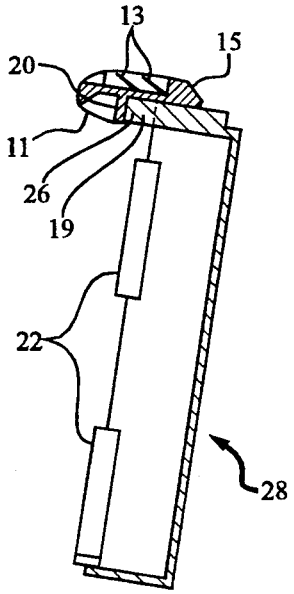
FIG. 3 is a sectional view of the housing and the razor blade which are combined in a conventional T-shaped razor.

Said conventional disposable razor blade assembly, as shown in FIG. 1 and FIG. 2, may consist of a front panel (15), a back panel (11) and one or two blades (13) so inserted between said front panel and back panel and arranged in a slanted position so as to expose only the cutting edge of blade outwardly therefrom.

The back panel (11) of the razor blade assembly may comprise on its surface a longitudinal reinforcing support (20) and one or more protrusions (19) which can be matched with said connecting means (26) formed on the upper end of the brim of said housing whereby said razor blade assembly is connected with said housing to form a T-shape and thereby fulfil its proper configuration and function as a shaving razor device.

As shown in FIG. 1, the peripheral edge of said recess of the gas lighter has a low upright wall (6) in order to removably match and fix the fixing means (22) formed on brim of the opening (30) to said L-shaped recess (5) of the lighter. Said low upright wall (6) of the recess (5) and said fixing means (22) of said housing can fix and attach to each other by virtue of the elasticity of the material to form a connection between themselves, or can be fitted by virtue of tight friction between these two components, or, as shown in FIG. 6, can be connected by sliding onto rails (31) (32) which have slanted sections in the direction to parallel to the longitudinal axis so as not to permit the housing to separate easily from the L-shaped lighter body.

In order to keep the razor blade assembly fixed and contained in the hollow space (29) of housing (28), one side of the connecting means (22) of the housing (28) may have one or more small protrusions (24) which correspond to the holes (18) formed on the front panel (15) of the razor blade assembly (17).

Figure 4A:
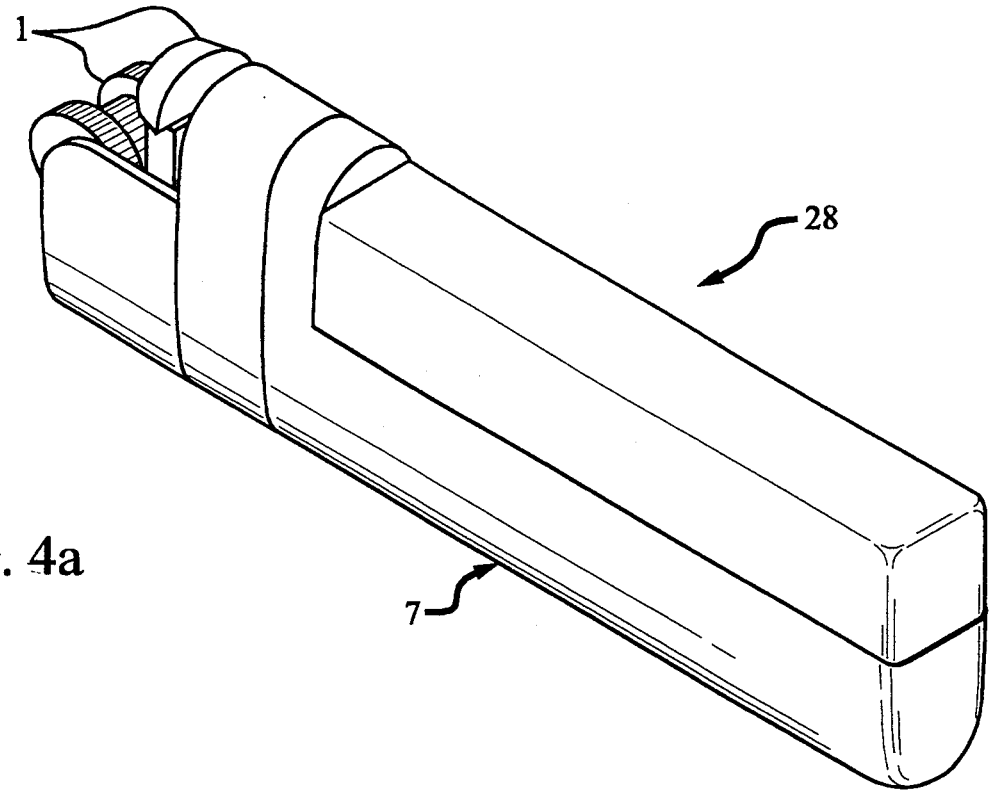
FIG. 4 (*a*)(*b*) are the perspective views of gas lighters which have different housing shapes respectively.
Figure 4B:
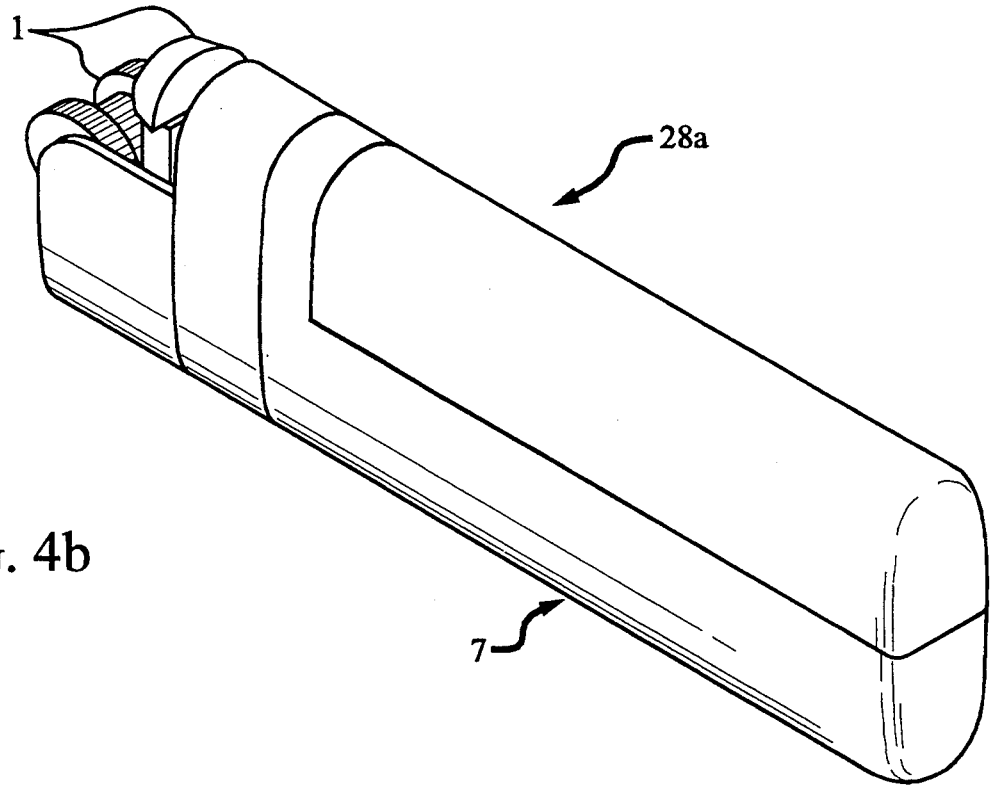

FIG. 4 (*a*)(*b*) show the perspective views of the gas lighter having different housing shapes respectively. These teach that the shape of the housing of the invention can be altered arbitrarily without changing the spirit and scope of the invention so long as it satisfies its own function according to the present invention, that is, keeping the disposable razor blade assembly at most times contained within the body of the conventional gas lighter and being used as a handle of the razor in shaving.

Figure 5A:
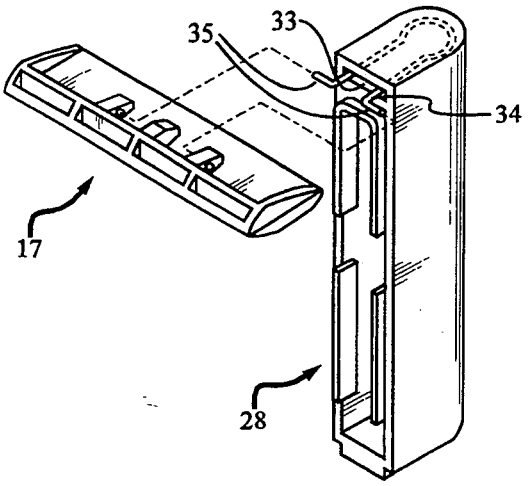
FIG. 5 (*a*)(*b*) are the perspective views of the housings and the blades which show different connecting means respectively.
Figure 5B:
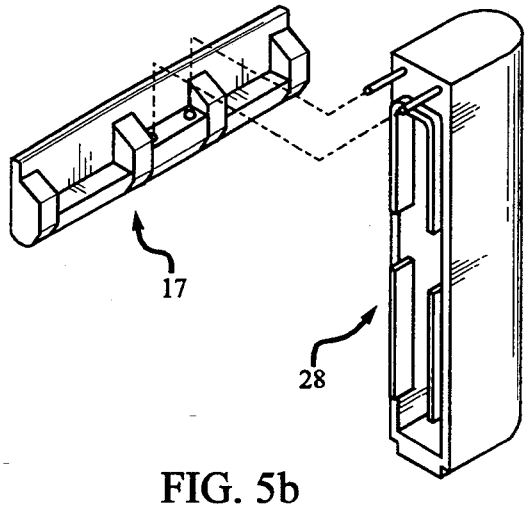
Figure 6:
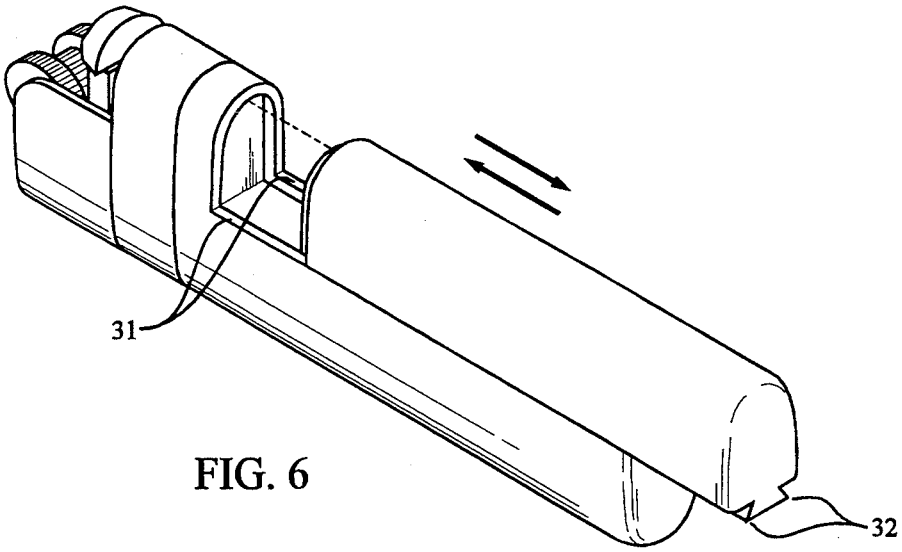
FIG. 6 is a perspective view of the gas lighter and the housing which have rail type connecting means.

FIG. 5 and FIG. 6 show another embodiment of the subject disposable razor blade assembly (17) and two varieties of the connecting means (26) corresponding to fit the shape of the back panel of the razor blade assembly (17).

In the FIG. 5, the housing has a flat aperture (33) perpendicular to the longitudinal axis at one end thereof and an oblong Ω-shaped hook (34) which is so inserted in said flat aperture (33) in such a way that both its outwardly hooked ends (35) are exposed outwardly. Said oblong Ω-shaped hook can be inserted in and removed from said flat aperture (33) and this construction can help to increase the productivity of the housing by virtue of the design of the invention.

FIGS. 5 and 6 also teach that the connecting means formed at one end of the housing (28) should be construed to be changable into other forms or shapes according to the form or shape of the back panel of the conventional disposable razor blade assembly (17).

From the present invention described above a gas lighter equipped with a disposable razor blade assembly is provided, wherein a part of the gas lighter's body is so shaped as to be suitable to fix a removable housing which, on one hand, keeps and contains a disposable razor blade assembly therein and which is, on the other hand, also used as a handle of the razor in shaving so as to enhance the convenience and portability of the razor at most times and can aid in preventing environmental pollution.

What I claim are:

1. A gas lighter equipped with a disposable razor which is characterized in that said gas lighter comprises:

(a) a gas lighter comprising an elongated casing having a longitudinal axis, an outer surface having a recess formed along with said longitudinal axis and a conventional igniter at one end of said elongated casing; and (b) a housing which has a longitudinal compartment therein for containing a conventional, disposal razor blade assembly therein, a longitudinal opening through which the disposal razor blade assembly can be inserted and removed, a connector on an upper end of a brim of said of longitudinal opening, the connector being able to connect the housing with and be removed from the razor blade assembly whereby said housing can be used as a handle of the razor is shaving, and a fixer for fixing on the brim of longitudinal direction of the housing so formed as to fix and remove said housing with said longitudinal recess of the lighter.

2. The gas lighter equipped with a disposable razor according to claim 1, wherein said gas lighter further comprises a conventional disposable razor blade assembly, which is kept in said longitudinal compartment of the housing when the razor is not being used but is capable of being removed and assembled in a T-shape for use as a razor during shaving.

3. The gas lighter equipped with a disposable razor according to claim 1, wherein the peripheral edge of said recess of the gas lighter has a low upright wall in order to match and be fixed or removed from the fixer formed on the brim of the opening of the housing, said fixer consisting of one or more longitudinal elastic protrusions which match the inside of said low upright wall.

4. The gas lighter equipped with a disposable razor according to claim 1, wherein said recess of the gas lighter and said connector of the housing is slidably connected with each other by way of such connector being able to slide under rails which are formed on the longitudinal edges of said recess and on the longitudinal brims of said opening, said rails having a slanted section so as to prevent removal of the housing oriented in a direction parallel to the longitudinal axis.

5. The gas lighter equipped with a disposable razor according to claim 1, wherein said connector to connect the housing with the razor blade assembly is a oblong Ω-shaped hook which is inserted in a flat aperture formed substantially perpendicular to the longitudinal axis at one end of the housing in such a way that both its hooked ends are exposed outwardly.

* * * * *